United States Patent [19]

Kluempers

[11] 3,973,357

[45] Aug. 10, 1976

[54] DOOR CLOSER WITH SWITCH ACTUATED THEREBY

[75] Inventor: Thomas J. Kluempers, Affton, Mo.

[73] Assignee: C. Hager & Sons Hinge Manufacturing Company, St. Louis, Mo.

[22] Filed: July 15, 1974

[21] Appl. No.: 488,656

[52] U.S. Cl. ..... 49/13; 335/205; 200/61.62

[51] Int. Cl.[2] ..... G08B 13/08

[58] Field of Search ..... 49/13, 14, 43; 16/185 H, 55; 200/61.62, 61.7; 335/205–207

[56] References Cited

UNITED STATES PATENTS

| | | | |
|---|---|---|---|
| 1,748,509 | 2/1930 | Forman | 49/14 X |
| 2,866,224 | 12/1958 | Ellis | 16/55 |
| 3,161,742 | 12/1964 | Bagno | 200/61.62 X |
| 3,497,997 | 3/1970 | Sheckells | 49/43 |

*Primary Examiner*—Kenneth Downey
*Attorney, Agent, or Firm*—Gravely, Lieder & Woodruff

[57] ABSTRACT

A door closer has a case set in the floor and a rotatable spindle projected from the case. The spindle supports a door and rotates with the door as the door pivots between open and closed positions. Within the case the spindle is coupled with a rotatable element which is acted upon by a return spring to bring the door to its closed position. The rotatable element carries a magnet which is located opposite to a magnetic reed switch on the case when the door is in a selected position and thereby closes a circuit to indicate the position of the door.

10 Claims, 5 Drawing Figures

DOOR CLOSER WITH SWITCH ACTUATED THEREBY

BACKGROUND OF THE INVENTION

This invention relates in general to doors and more particularly to a door closer provided with means for indicating the position of the door.

At some door openings it is neither desirable nor possible to mount the door, which normally closes the opening, on conventional leaf-type hinges. For example, many modern buildings have doors which are substantially all glass. These doors contain a large thick slab of glass which extends from one side edge of the door to the other. Obviously, hinges cannot be secured directly to the glass. Normally, the upper and lower ends of the glass slabs are capped with metal rails and the lower rail is supported on the spindle of a door closer, whereas upper rail is connected to a top pivot which is mounted on the lintel piece of some other member extended over the door opening.

Moreover, many buildings of the modern construction utilize electrically operated surveillance systems instead of watchmen to detect and discourage unauthorized entries. These systems actually maintain surveillance over doors at critical locations in the buildings and signal an alarm when any one of the doors is opened, even momentarily, at a time when it should not be. Heretofore, devices have been incorporated into hinges for closing an alarm circuit when the hinge leaves part and hence detecting the opening of the door hung with such hinges. The Switch Hinge of U.S. Pat. No. 3,715,537, the Contact Hinge of U.S. Pat. No. 3,659,063, and the Interrupted Slip Ring Hinge of U.S. Pat. application Ser. No. 375,788, filed July 2, 1973, are all capable of making and breaking an electrical circuit in response to movement of the hinge leaves and hence are suitable for use in surveillance systems for hinge hung doors. These hinges completely obscure the electrical circuitry and circuit interrupting means when the door is closed and cannnot be tampered with by potential intruders. However, no tamper-proof arrangement has been developed for doors supported on so-called door closers.

Aside from the foregoing, it is often necessary to ascertain when a door is precisely in its closed position so that a bolt may be thrown from a remote location to secure the door. Again, hinges have been developed which provide the foregoing determination in the case of hinge hung doors, but not for closer mounted doors.

SUMMARY OF THE INVENTION

One of the principal objects of the present invention is to provide a means of ascertaining from a remote location the position of doors pivoted on door closers. Another object is to provide detecting means of the type stated which indicates when the door moves out of its closed position. An additional object is to provide detector means of the type stated which is easily incorporated into conventional door closers. These and other objects and advantages will become apparent hereinafter.

The present invention is embodied in a door closer having a movable element which moves in response to movement of the door and switch means for indicating when the movable element is in a selected position. The invention also consists in the parts and in the arrangements and combinations of parts hereinafter described and claimed.

DESCRIPTION OF THE DRAWINGS

In the accompanying drawings, which form part of the specification and wherein like numerals and letters refer to like parts wherever the occur.

DETAILED DESCRIPTION

Figure 1:
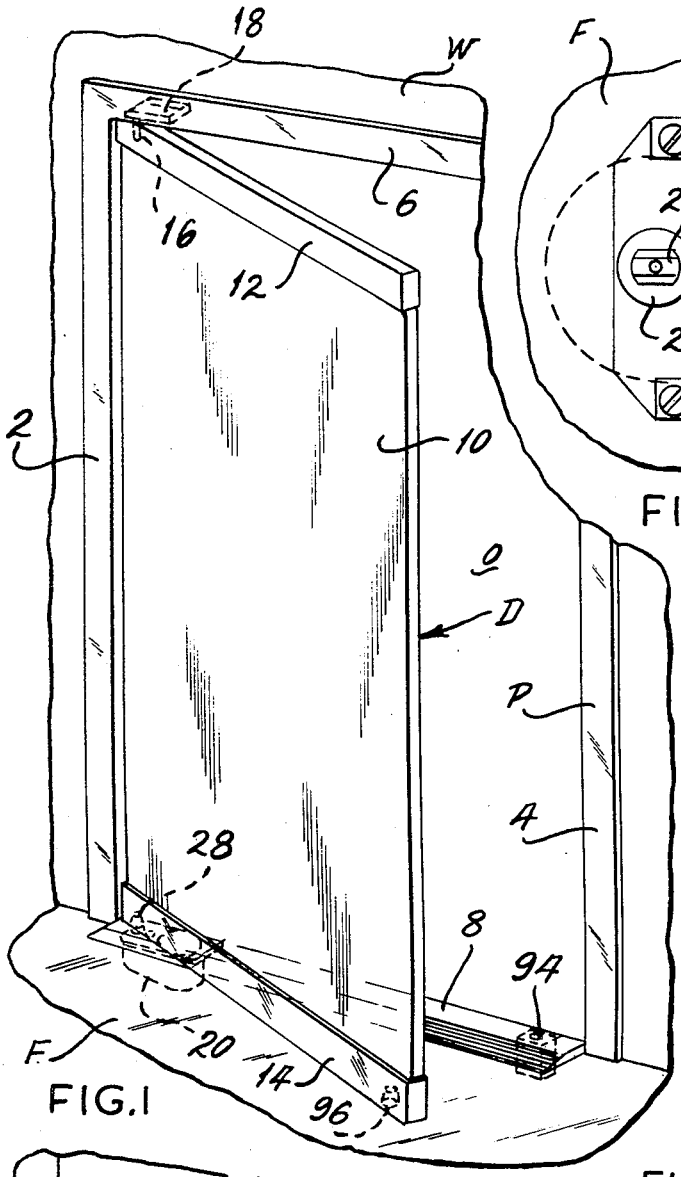
FIG. 1 is a perspective view of a door supported on a door closer constructed in accordance with and embodying the present invention.

Referring now to the drawings (FIG. 1), a wall W extends upwardly from a floor F which may be poured concrete. The wall F contains a door frame P which delineates a door opening O through the wall W, and the frame P includes a pivot jamb 2, an outside jamb 4, and a header 6 extended between the upper ends of the two jambs 2 and 4. Extended between the lower ends of the jambs 2 and 4 is a threshold 8 which is secured firmly to the floor F and may be an aluminum extrusion. The door opening O is normally occupied and closed by a door D which pivots adjacent to the pivot jamb 2 to an open position and is essentially all glass.

Figure 2:
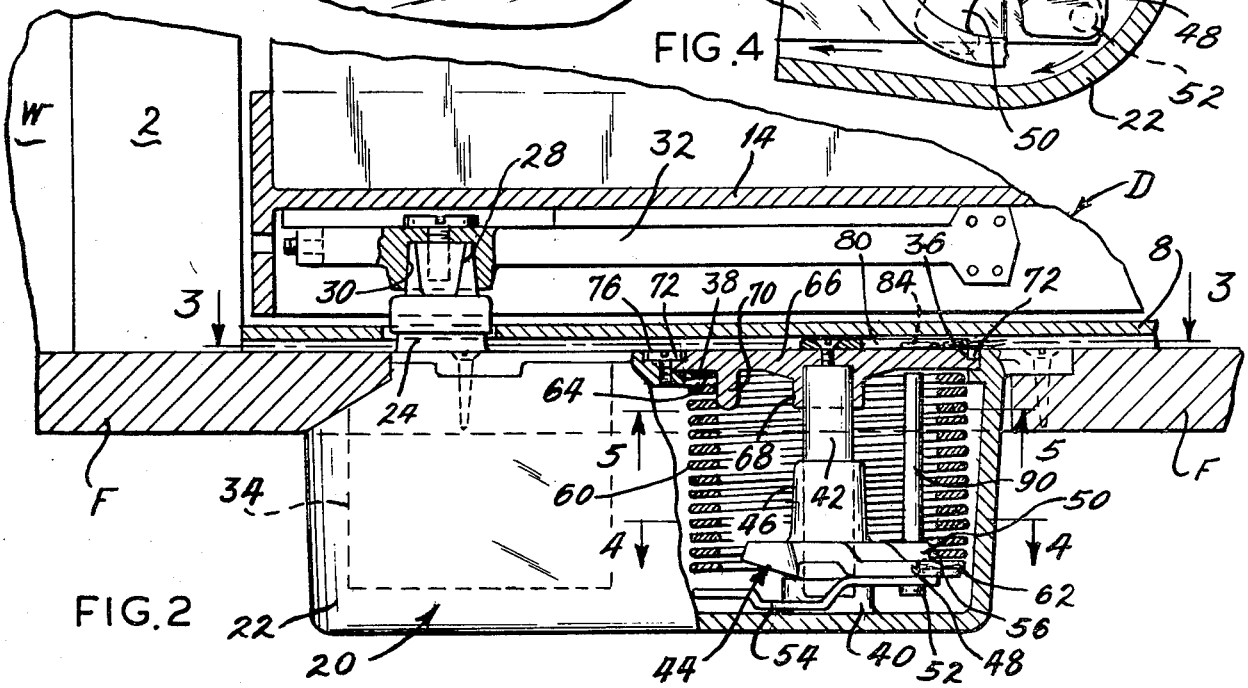
FIG. 2 is a sectional view taken along line 3—3 of FIG. 1.

Actually the door D consists of a large slab of glass 10 which extends from one side edge of the door D to the other. The slab 10 also extends substantially the entire height of the door D, but its upper edge is capped with a top rail 12, and at its lower edge is encased in a bottom rail 14. A space or void exists within the top rail 12 between the upper edge of the slab 10 and the upper portion of the rail 12 and likewise another void exists within the bottom rail 14 between the lower edge of the slab 10 and the lower portion of the rail 14 (FIG. 2).

Projecting downwardly the header 6 of the door frame P adjacent to the hinge jamb 2 is a top pivot 16 (FIG. 1) which further projects into the top rail 12 of the door D to enable the door D to swing about the axis of the pivot 16. Actually, the pivot 16 forms part of a pivot assembly 18 which is mounted on the lintel behind the header 6.

While the upper end of the door D is confined by and pivots about the top pivot 16, the lower end rests on a door closer 20 (FIGS. 1 and 2) embedded in the floor F. Not only does the door closer 20 support the door 2, and permit it to pivot about the axis of the top pivot 16, but it also slowly returns the door D to its closed position wherever the door D is opened and thereafter left unrestrained.

Figure 3:
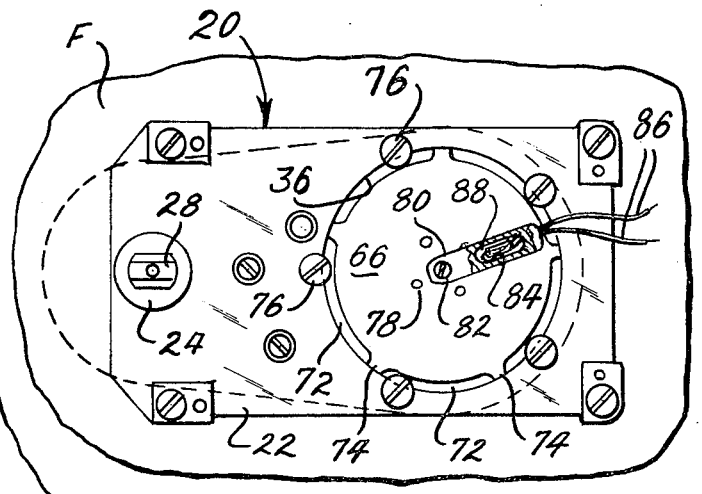
FIG. 3 is a top plan view of the door closer.

The door closer 20 includes a cast metal case 22 (FIGS. 2 and 3) which is located entirely within the floor F adjacent to the lower end of the pivot jamb 2 and below the threshold 8. In the case of a poured concrete floor; the case 22 is blocked into the proper position, and then the concrete is poured around it and finished generally flush with the upper surface of the case. Near its end closest to the hinge jamb 2, the case 22 has a boss 24 projected upwardly from the upper surface thereof, and this boss contains a bearing, the axis of which is coincident with the axis of the top pivot 16. The bearing in the boss 24 receives a spindle 28 which projects beyond the case 22 and into the bottom rail 14 of the door D (FIG. 2). The spindle 28 rotates within the boss 24 through a limited arc and is coaxial with the top pivot 16. Actually, the upper end of the spindle 28 projects into a socket 30 in an arm 32 which is secured to the bottom rail 14. Both the socket 30 and the upper end of the spindle 28 are non-circular so that the spindle 28 rotates relative to the case 22 when the door D is opened and closed.

The interior of the case 22 is hollow and directly beneath the spindle 28 contains a damper assembly 34 (FIG. 2) into which the spindle 28 projects. Normally, the spindle 28 is in a home position in which the door D supported on it is closed. The damper assembly 34 does not significantly impede movement of the spindle 28 away from this home position, but once the spindle 28 is so displaced, the damper assembly 34 checks or impedes rotation back to the home position. The damper assembly 34 is adjustable from the top surface of the case 22 so that the rate at which it allows the spindle 28 to return to its home position can be varied. In addition to the damper assembly 34, the closer 20 includes stop means (not shown) for limiting the amount of arcuate movement for the spindle 28. Both the damper assembly 34 and the means are conventional.

Figure 5:
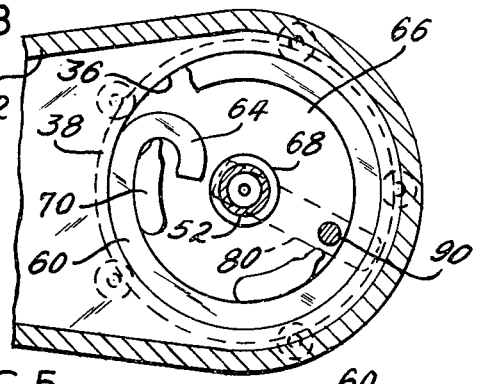
FIG. 5 is a sectional view taken along line 5—5 of FIG. 2 and showing the underside of the cover plate.

Access to the interior of the case 22 is gained through a large circular opening 36 (FIGS. 2, 3 and 5) which is located in the top wall of the case 22 at the end opposite that from which the boss 24 projects. The opening 36 is counterbored from the top surface of the case 22 to provide a flange or lip 38 (FIG. 2) in the top wall of the case 22.

Figure 4:
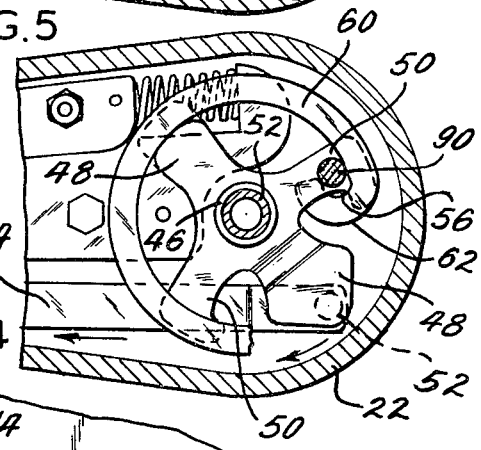
FIG. 4 is a sectional view taken along line 4—4 of FIG. 2 and showing the winding spider.

Cast into the bottom wall of the case 22 and projecting into the hollow interior thereof is a boss 40 (FIG. 2) from which a machined pin 42 extends upwardly, with the axis of the pin 42 being concentric with the circular opening 36. The pin 42 serves as a journal for a rotatable spring winding element or spider 44 (FIGS. 2 and 4) including a center hub 46 through which the pin 42 extends and a pair of supporting arms 48 projecting radially from the hub 46 180° apart and a pair of driving arms 50 also projecting radially from the hub 46 and offset about 90° with respect to the supporting arms 48. One of the supporting arms 48 carries a pin 52 which is offset from the axis of the pin 42 and projects downwardly into a drive link 54. Thus, the supporting arm 48 into which the pin 52 is fitted functions as a crank arm. The drive link 54 extends along the bottom wall of the case 22 and is connected to the spindle 28 through a crank arm arrangement in the damper assembly 34. The connection is such that when the spindle 28 rotates the drive link 54 will move longitudinally of the case 22 and will cause the spider 44 to also rotate, with the angular displacement of the spider 44 being about equal to that of the spindle 28. Hence, when the door D is opened the spider 44 will rotate through an angle about the same as the angular displacement of the door D. Each of the spring driving arms 50 has a lug 56 projected downwardly from it.

The winding spider 44 supports a coil-type torsion spring 60 (FIGS. 2 and 4) the diameter of which is small enough to enable the spring 60 to pass through the circular opening 36. Indeed, the spring 60 rises from the spider 44 to the circular opening 36 and when unrestrained in the axial direction will project slightly above the opening 36. The lowest convolution of the spring 60 rests on the two supporting arms 48 of the spider 44, and this convolution terminates at a hook 62 which turns inwardly toward the axis of the spring 60 and loops around the lug 56 on one of the spring driving arms 50. In this regard, the lugs 56 on the two driving arms 50 face in opposite directions so as to enable the spider 44 to accommodate a torsion spring 60 wound in either direction. The uppermost convolution of the spring 60 also has a hook 64 on it, and this hook is likewise turned inwardly toward the axis of the spring 60.

The circular opening 36 is closed by a circular cover plate 66 (FIGS. 2, 3 and 5) which is made from a nonferrous metal such as aluminum and fits into the opening 36 where it rests on the lip 38 of the case 22. On its underside the plate 66 has a boss 68 (FIGS. 2 and 5) provided with a socket which receives the upper end of the pin 42 so that the pin 42 is confined at both its upper and lower ends. The plate 66 also has a downwardly projecting lug 70 which aligns with and is engaged by the hook 64 on the uppermost convolution of the spring 60. The lugs 56 and 70 on the spider 44 and cover plate 66, respectively, and the hooks 62 and 64 on the spring 60 are all arranged such that when the spider 44 is rotated as a result of the spindle 28 moving away from its home position, the lower hook 62 will move with the driving arm 50 of the spider 44 whereas the upper hook 64 will remain fixed against the lug 70 of the cover plate 66, and the spring 60 will decrease slightly in diameter.

On its upper surface, the plate 66 has a peripheral recess 72 (FIG. 3) which is interrupted at equal circumferential intervals by radial projections 74. The plate 66 is secured within the circular opening 36 by screws 76 which thread into the upper wall of the case 22 adjacent to the periphery of the opening 36 and have enlarged heads which extend into the peripheral recess 72 of the plate 66. Hence, the heads of the screws 76 prevent the plate 66 from rotating in the opening 36. However, when the screws 76 are backed off sufficiently, the projections 74 will pass under the enlarged screw heads so that the plate 66 can be turned to wind the spring 60 and thereby increase the force required to turn the spindle 28. In order to turn the plate 66, it is provided with several outwardly opening blind holes 78 near its center which receive a special wrench.

The cover plate 66 carries a switch arm 80 (FIGS. 2 and 3) which is formed from a nonferrous material such as brass or aluminum and is secured to the plate 66 by a machine screw 82 threaded into the circular plate 66 at the center thereof. Thus, the screw 82 is located along the axis of the pin 42 which is the axis about which the spider 44 rotates. When the screw 82 is loose the arm 80 can rotate relative to the plate 66 and the case 22, but when the screw 82 is tightened the arm 80 is fixed firmly in position on the plate 66. On its underside the switch arm 80 has a recess in which a magnetic reed switch 84 is disposed, and this switch is interposed between two leads 86 which extend out of the end of the switch arm 80. The reed switch 84 is embedded in a non-magnetic castable material 88 which occupies the remainder of the recess and is oriented with the major surfaces of its overlapping reeds parallel to the plane of the plate 66. When not subjected to a magnetic field of sufficient strength the overlapping reeds of the switch 84 are parted. However, when the switch 84 is brought into a magnetic field with the major surfaces of the reeds perpendicular to the lines of force of that field, the reads will be drawn together and will complete a circuit between the leads 86.

Threaded into the one of the arms 48 or 50 on the spider 44 and preferably into one of the driving arms 50 is a post 90 (Figs. 2 and 4) which projects upwardly from the spider 44 parallel to the pin 42. The upper end of the post 90 is located close to the underside of the plate 66 and is further positioned far enough inwardly so as not to interfere with the lug 70 on the cover plate 66 or the hook 64 engaged by the lug 70 when the cover plate 66 turned. The post 90 is formed from a ferrous material which when magnetizied retains the magnetism, and this material is magnetizied with the poles at the ends of the post 90. In other words, the post 90 constitutes a bar magnet having its poles located outwardly from the center of the pin 42 which is the axis of rotation for the winding spider 44. Thus, the upper pole of the magnet or post 90 will describe an arc as the spider 44 revolves. Also, both the post 90 and the switch 84 are located the same distance from the axes of the pin 42 so the upper end of the post 90 can assume a position directly beneath the switch 84, in which case the magnetic field of the post 90 will close the switch 84.

To secure the door D in its closed position, a remotely controlled bolt 94 (FIG. 1) may be embedded in the floor F near the outside jamb 4. The bottom rail 14 has a downwardly opening socket 96 which receives the bolt 94 when the bolt 94 is elevated. The bolt 94 may either be moved by a solenoid or by an air cylinder, but in either case it is electrically controlled from a remote location. A suitable air operated bolt is disclosed in the application of Francis C. Peterson entitled LOCKING DEVICE FOR DOOR, that application being filed contemporaneously with this one.

OPERATION

The door closer 20 is normally preset at the factory, at least insofar as the return spring 70 is concerned, so that the spring 70 exerts sufficient torque on the spider 44 to return the door D to its closed position when the door D is opened. In this connection, the spring 70 is normally wound and hence under torsion when the door D is in its closed position. The stop means within the closer 20 prevents the wound spring 70 from swinging the door D completely through the opening O in the opposite direction. Whenever the door D is opened in the proper direction the spindle 28 rotates, and this rotation is translated to the spring winding spider 44 through the damper assembly 34 and the drive link 54. The rotation of the spider 44 is such that it winds the spring 70 still further. Therefore, the door D experiences progressively greater resistance as it reaches its fully open position. Once the door D is released, the spring 70 rotates the spider 44 back to its initial position and the spider 44 acting through the link 54 turns the spindle 28 and brings the door D back to its closed position. Thus, the spider 44 rotates in one direction when the door D is opened and in the opposite direction when the door D is closed.

If the return force exerted on the door D when it is open is not great enough or is too great, that force can be adjusted by loosening the screws 76 until their enlarged heads are above the radial projections 74 on the plate 66 and by then turning the plate 66 with the special wrench engaged in the blind holes 78. Depending on the direction the plate 66 is turned, the spring 70 will either be wound further or unwound. When the proper adjustment is obtained the screws 76 are run down so that the heads are in the peripheral recess 72 of the plate 66. The damper assembly 34 checks the rate at which the door closes and can likewise be adjusted.

Once the cover plate 66 is in the position which places the proper amount of prewind on the spring 70 and the screws 76 are run down to secure the plate 66 in that position, the screw 82 for the switch arm 80 is backed off, and with the door D in its closed position, the arm 80 is rotated until the magnetic reed switch 84 closes. This is easily determined with a simple continuity tester placed across the leads 86. The screw 82 is then tightened to secure the arm 80 in that position. When the arm 80 is so positioned, the switch 84 carried by it is directly over the magnetic post 90 on the spider 44.

Now when the door D opens and the spider 44 rotates, the post 90 will be moved out of alignment with the switch 84 and the switch 84 will open. Thus, the switch 84 signals when the door is precisely in its closed position and conversely when it is displaced from the open position.

When coupled with an alarm, the switch 84 will provide a signal at a remote location that the door D has been opened and this will alert security personnel as to a possible unauthorized entry.

Similarly, if the remotely controlled bolt 94 is utilized to secure the door D in its closed position, the switch 84 will signify when the door D is precisely in its closed position so that the bolt 94 when thrown will project into the socket 96 in the bottom rail 14 and not merely project into the opening O without engaging the door D. The bolt 94 is electrically actuated and the switch 84 should be in series with the electrical actuating mechanism so that the circuit to the actuating mechanism will not be completed until the door D is precisely in its closed position.

Of course, the switch 84 can be used to indicate when the door D is in another position, this being achieved by rotating the switch arm 80 until the switch 84 is directly above the post 90 when the door D is in the selected open position.

This invention is intended to cover all changes and modifications of the example of the invention herein chosen for purposes of the disclosure which do not constitute departures from the spirit and scope of the invention.

What is claimed:

1. A door closer for supporting a door above a floor and for moving the door to a closed position with respect to a door opening, said door closer comprising: a case mounted firmly on the floor; a rotatable spindle projecting upwardly from the case and supporting the door, the spindle being nonrotatively connected to the door so that the door pivots about the axis of the spindle and rotates the spindle as the door opens and closes; a rotatable element which rotates about a fixed axis in the case, the axis of the rotatable element being offset from the axis of the spindle; connecting means between the spindle and the rotatable element for rotating the rotatable element in response to rotation of the spindle, and vice-versa; spring means connected to the rotatable element for returning the rotatable element to a home position; a bar magnet carried by the rotatable element and having at least one pole located outwardly from the axis of rotation for the rotatable element so that said one pole describes an arc as the rotatable element revolves, the longitudinal axis of the bar magnet being located at an angle with respect to the plane in which the arc lies; and a switch mounted in a normally fixed position with respect to the case, said position being adjacent to the arc described by said one pole of the magnet, the switch being sensitive to a magnetic field, whereby when said one pole of the magnet moves adjacent to the switch, the switch will be actuated to indicate a selected position of the door.

2. The structure according to claim 1 wherein the switch is mounted on a nonferrous cover plate which is attached to the case, and wherein the spring means is a coiled torsion spring having one end anchored to the movable element and the other end anchored to the cover plate.

3. A door closer according to claim 1 wherein the spring means comprises a coiled torsion spring anchored at one end to the rotatable element and having its other end anchored in a fixed position with respect to the case, and wherein the magnet is surrounded by convolutions of the spring.

4. The structure according to claim 1 and further comprising an arm mounted on the casing in a normally fixed position but being adjustable about a pivot point which lies along the axes of rotation for the rotatable element, and wherein the switch is carried by the arm and is spaced from the pivot point a distance which is substantially the same as the radius of the arc described by said one pole of the magnet.

5. A door closer according to claim 1 and further comprising means for adjusting the position of the switch along the arc described by said one pole of the magnet.

6. A door closer according to claim 5 wherein the means for adjusting the position of the switch comprises an arm mounted on the case and rotatable about the axis of the rotatable element, the switch being on the arm, and means for securing the switch in a fixed position with respect to the case.

7. The structure according to claim 1 wherein the longitudinal axis of the bar magnet is parallel to the axis of rotation for the rotatable element.

8. The structure according to claim 7 wherein the spring means comprises a coil-type torsion spring having its one end engaged with the case and its other end engaged with the rotatable element, and wherein the bar magnet is encircled by the convolutions of the spring.

9. In a door closer for returning a door to its closed position when opened and including a casing, a nonferrous cover plate on the casing, a spindle on the casing and supporting the door such that it is coaxial with the pivot axis of the door and rotates as the door opens and closes, a movable element rotatable in the casing about an axis fixed with respect to the casing, means coupling the spindle and the movable element for rotating the movable element in unison with and in predetermined relation to the spindle, whereby the movable element assumes a home positon when the door is closed, and a coiled tension spring having one end anchored to the movable element and the other end anchored to the cover plate such that the spring acts upon the movable element and will return the movable element to its home position, whereby the door is urged to its closed position, the improvement comprising: a magnet mounted on the movable element and being rotatable therewith, an arm rotatable relative to the cover plate about an axis coincident to the axis of rotation for the movable element, means for securing the arm in a fixed position with respect to the cover plate, a magnetic reed switch mounted on the arm and in a normally fixed position with respect to the casing, the reed switch being directly opposite the magnet when the movable element is in a selected position, whereby the magnet will actuate the switch when the movable element is in the selected position.

10. The structure according to claim 9 wherein the cover plate is rotatable relative to the casing to adjust the torsion exerted by the spring on the movable element.

* * * * *